US010782068B2

(12) United States Patent
McFarlane

(10) Patent No.: US 10,782,068 B2
(45) Date of Patent: Sep. 22, 2020

(54) APPARATUS AND METHOD FOR TREATING FABRIC

(71) Applicant: TECHNIJET DIGITAL LIMITED, Carnforth (GB)

(72) Inventor: David McFarlane, Carnforth (GB)

(73) Assignee: Technijet Digital Limited, Carnforth (GB)

( * ) Notice: Subject to any disclaimer, the term of this patent is extended or adjusted under 35 U.S.C. 154(b) by 6 days.

(21) Appl. No.: 15/771,238

(22) PCT Filed: Nov. 4, 2016

(86) PCT No.: PCT/GB2016/053436

§ 371 (c)(1),
(2) Date: Apr. 26, 2018

(87) PCT Pub. No.: WO2017/077321

PCT Pub. Date: May 11, 2017

(65) Prior Publication Data

US 2018/0236782 A1 Aug. 23, 2018

(30) Foreign Application Priority Data

Nov. 6, 2015 (GB) ..... 1519680.1

(51) Int. Cl.
*B41J 3/407* (2006.01)
*B41J 11/00* (2006.01)
(Continued)

(52) U.S. Cl.
CPC ..... *F26B 13/10* (2013.01); *B41J 3/4078* (2013.01); *B41J 11/002* (2013.01);
(Continued)

(58) Field of Classification Search
CPC ..... B41J 3/4078; B41J 11/002; D06P 5/30; D06B 1/02; F26B 3/30; F13B 13/008
See application file for complete search history.

(56) References Cited

U.S. PATENT DOCUMENTS 2,084,189 A 6/1937 Bulford
3,594,213 A 7/1971 Rudman
(Continued)

FOREIGN PATENT DOCUMENTS

CN 1764754 A 4/2006
CN 1849492 A 10/2006
(Continued)

OTHER PUBLICATIONS

Great Britain Search Report for GB 1519680.1 dated Mar. 18, 2016.
(Continued)

*Primary Examiner* — Kristal Feggins
*Assistant Examiner* — Kendrick X Liu
(74) *Attorney, Agent, or Firm* — Shumaker, Loop & Kendrick, LLP

(57) ABSTRACT

The apparatus (100) comprises several stations for treating fabric (10). For example, a cleaning station (20) is provided that is arranged to remove loose debris from the fabric and move the fabric in a continuous motion through the cleaning station. A treatment station (40) is then arranged to receive the fabric from the cleaning station and to transfer treatment fluid to the fabric in a treatment zone. Finally, a drying station (50) is arranged to receive the fabric from the treatment station and to dry the fabric in a drying zone. Advantageously, the treatment station is arranged to transfer the treatment fluid by spraying the treatment fluid under pressure onto a side of the fabric.

4 Claims, 7 Drawing Sheets

(51) Int. Cl.

| | |
|---|---|
| ***D06P 5/30*** | (2006.01) |
| ***D06P 5/02*** | (2006.01) |
| ***D06B 1/02*** | (2006.01) |
| ***F26B 3/30*** | (2006.01) |
| ***F26B 13/00*** | (2006.01) |
| ***F26B 13/10*** | (2006.01) |
| ***D06B 15/00*** | (2006.01) |

(52) U.S. Cl.

CPC ..... *B41J 11/0015* (2013.01); *D06B 1/02* (2013.01); *D06B 15/00* (2013.01); *D06P 5/02* (2013.01); *F26B 3/30* (2013.01); *F26B 13/00* (2013.01); *F26B 13/002* (2013.01); *F26B 13/008* (2013.01); *D06P 5/30* (2013.01)

(56) References Cited

U.S. PATENT DOCUMENTS

| | | | | |
|---|---|---|---|---|
| 5,010,659 | A | 4/1991 | Treleven | |
| 5,447,785 | A * | 9/1995 | Kishi | B29C 70/08 139/36 |
| 2006/0204657 | A1 * | 9/2006 | Baker | B82Y 30/00 427/180 |
| 2007/0011906 | A1 * | 1/2007 | Morita | F26B 3/283 34/543 |

FOREIGN PATENT DOCUMENTS

| | | | |
|---|---|---|---|
| DE | 549718 | C | 8/1932 |
| DE | 19 45 532 | A1 | 3/1971 |
| DE | 2154183 | A1 | 5/1973 |
| DE | 199 15 059 | A1 | 10/2000 |
| EP | 1 288 091 | A1 | 3/2003 |
| GB | 2 153 507 | A | 8/1985 |
| JP | H07207569 | A | 8/1995 |
| JP | 2005206974 | A | 8/2005 |
| WO | WO 2004/085739 | A2 | 10/2004 |
| WO | 2012/035179 | A1 | 3/2012 |
| WO | 2015/005207 | A1 | 1/2015 |
| WO | 2015/048840 | A1 | 4/2015 |

OTHER PUBLICATIONS

Examination Report issued by the Intellectual Property Office of Great Britain in related Application No. GB1519680.1, dated Oct. 10, 2018, 5 pages.[Art has been previously cited; IDS filed May 8, 2018 cited U.S. Pat. No. 5,010,659 (Treleven), WO 2004/085739 (INKTEC CO LTD), and DE 1945532 (Busch Udo) and IDS filed Apr. 26, 2018 cited WO 2012/035179A (Garcia)].

International Search Report carried out by the EPO for PCT/GB2016/053436 dated May 8, 2017.

European Communication puresuant to Rule 164 (2)(b) and Article 94(3) EPC in EP application No. 16794002.2; dated Oct. 17, 2019; 7 pages (only new references are cited herein; previously cited art—IDS filed May 8, 2018 cited U.S. Pat. No. 5,010,659 (Treleven), WO 2004/085739 (INKTEC CO LTD), and DE 1945532 (Busch Udo) and IDS filed Apr. 26, 2018 cited WO 2012/035179A (Garcia)).

* cited by examiner

APPARATUS AND METHOD FOR TREATING FABRIC

FIELD

The disclosure relates to an improved apparatus and method for treating fabric.

BACKGROUND

It is known that fabrics have to be pre-treated with chemicals prior to digital printing in order to fix the printed ink. The pre-treatment chemicals are tailored to the type of ink. A typical process includes immersing the fabric in a chemical bath to treat it, drying the fabric and then printing onto the fabric. This pre-treatment process prior to the inkjet printing is often referred to as a padding and stenter process.

A known apparatus (1) for pre-treating fabric is shown schematically in FIG. 1. Typically, untreated fabric is provided as a roll (2). Optionally, the fabric (10) can be fed as a continuous sheet through a cleaner (3) to remove any lint broken down from the fabric (10) when unrolling and any dust present on the fabric (10). The fabric (10) is then submersed in a chemical bath (4) so that the fabric (10) becomes fully embedded with the pre-treatment chemicals. The pre-treatment chemicals are selected to meet the printing requirements. However, because the fabric (10) is immersed in the chemical bath, it is not easy to change the pre-treatment chemicals, for example in order to facilitate a change in printing ink type, without affecting down-time or fabric (10) integrity.

During the pre-treatment phase, lint and/or dust may further accumulate on the fabric (10) and may need to be further removed by another cleaning station (not shown). Once clean, the fabric (10) is then passed through a mangle (5) to remove excess fluid and then onto a stationary drier (6) before the dried pre-treated fabric (10) is rolled (7) for storage/dispatch. The drier, known as a stenter, is a large, stationary machine through which fabric (10) is continually passed. The slow warm-up and cool-down times of the stenter mean that the stenter is generally used in a steady state operation. Generally speaking, once the stenter is turned on, it is left on for hours, if not days. When a hot stenter is eventually turned off, fabric (10) must be continually moved through the stenter while the stenter is cooling because any fabric (10) that is stationary in the stenter may become scorched. This inability to quickly vary stenter conditions means that the stenter is inflexible and leads to processing of large batches of pre-treated fabric.

Each time the fabric (10) is manipulated or, in the least, in contact with another surface, the fabric (10) suffers localised damage. The localised damage results in the generation of lint (8) as shown in FIG. 2. If the lint (8) is present on a pre-treated fabric (10) prior to printing but is then removed during subsequent process stages, any areas containing the lint particles (8) having ink embedded thereon can result in patches void of ink (9) as the lint (8) flakes off. This effect also occurs due to the presence of dust or any other loose material on the surface of the pre-treated fabric. The consequence of lint and/or dust (8) present on a fabric (10) prior to printing is that the final finish quality is inferior due to the loss of ink (9) and the patchy finish.

When printing onto a pre-treated fabric by inkjet, the fabric is first treated as described and is then supplied in roll form to the printer. Normally, the two processes of pre-treatment and printing are separate (i.e. offline) because, unlike the pre-treatment process which feeds the fabric continuously, the nature of the inkjet printing process means that the fabric movement is intermittent. The current solution is therefore to supply individual printers with the specifically pre-treated roll of fabric. It is currently impractical to use the known systems to produce a continuous sheet of fabric that comprises different runs of chemical pre-treatment. The known pre-treatment system cannot easily stop and start because the down time between changes in line process conditions is too long. The known pre-treatment system is inflexible and lacks transient control (i.e. cannot quickly respond to changes in system setup). Typically, during the ink transfer stage, the pre-treated fabric is held still. This allows the inkjet heads to move across the width of the fabric and propel ink onto the fabric. Once a row or pass of ink has embedded onto the fabric, the fabric moves forward until the process starts again. This stepwise printing motion is different to the continuous motion on the pre-treatment process. Achieving compatibility between the two processes poses a challenge. Generally, the wider the roll of fabric, the longer the fabric must be held in position because the speed of the side-to-side movement of the inkjet head is fixed. If the fabric is held stationary in the stationary drier for too long, the fabric would begin to suffer thermal damage by scorching.

It is therefore an object of the present disclosure to improve the way fabric is pre-treated and printed by inkjet. It is desirable to provide a solution that integrates the pre-treatment and printing processes. It is further desirable to limit the presence of dust or the generation of lint during the pre-treatment and/or printing process. One general aim is to provide more customization and better control. A further general aim is to reduce the complexity of the working processes. Although the invention has been described in relation to pre-treatment for ink jet printing, it will be appreciated that the solution can be used in the treatment of fabric in other situations, and particularly to replace the use of other padding and stenter processes.

SUMMARY

According to the present invention there is provided an apparatus and method as set forth in the appended claims. Other features of the invention will be apparent from the dependent claims, and the description which follows.

According to an exemplary embodiment, a drying station for drying a coated fabric is provided. Suitably, the fabric being dried is impregnated with a chemical solution. The drying station includes an emitter supported by a drying support. The drying support may be a frame. The emitter is arranged to transfer thermal energy through the emission of infrared radiation. In some examples, the emitter comprises a tungsten lamp. The extent of the infrared radiation defines a drying zone, such that fabric present within the drying zone receives thermal energy from the infrared radiation. Advantageously, the radiant heating of the fabric allows the fabric to dry in an expedient manner. Furthermore, the emitter is configured to move in a predetermined way with respect to the drying support. For example, the emitter may pivot about an axis or move along a predetermined path. The predetermined movement allows the drying zone to span and successively dry a width of the fabric. When provided in roll form, the width may be a transverse direction to the roll axis. Advantageously, the moveable drying zone provides a more dynamic drying station such that the emitter is prevented from scorching the fabric. Suitably, radiant heat of at least 70 Kilowatts per square meter (commonly abbreviated $kW/m^2$) is emitted. Conveniently, the radiant heat emitted is below 320 Kilowatts per square meter. In one example, radiant heat of approximately 100 Kilowatts per square meter is emitted. The emitter may be configured to move at speeds proportional to the intensity of radiant heat or proximity to the fabric. Therefore, an improved drying station is provided.

As mentioned, the drying station may move along a predetermined path. This path may comprise at least a linear portion. The linear portion may be substantially parallel to a width of the fabric such that the emitter moves at fixed distance from the fabric. The ends of the path may deviate away from the linear portion. For example, the predetermined path may comprise an extension along which the emitter is adapted to move. The extension may be collinear with the predetermined path. The extension may comprise a linear or non-linear portion. Alternatively, the extension may be configured such that the emitter moves away from the plane through which the surface of the fabric extends. This helps to reduce the footprint of the extensions and reduce the transverse extent of the emitter movement. The extension may be configured such that when fabric is present within the predetermined path, the drying zone is moveable away from the fabric in order to prevent infrared radiation being directed towards the fabric. Advantageously, the extensions allow the emitter to remain switched on without impacting the fabric itself. Even if the emitter is switched on and held stationary along the extensions, the fabric can be held stationary without being scorched. The emitter may continuously move along the extensions.

According to an exemplary embodiment, a treatment station for impregnating fabric, suitably with a treatment chemical, such as a pre-treatment chemical, is provided. The treatment station comprises one or more nozzles having an outlet, wherein the nozzle is supported by a treatment support and arranged to spray treatment chemical fluid under pressure through the outlet and towards a fabric. It will be appreciated that the chemical fluid may be a mixture of chemicals or a chemical solution as required in the art. The treatment support may be a frame. The extent of the spray defines a spraying zone, such that when fabric is present within the spraying zone, the fabric is coated by the sprayed treatment chemical. Typically, the chemical fluid is impregnated into the fabric. Furthermore, the nozzle is configured to move in a predetermined way with respect to the treatment support along. For example, the nozzle may pivot about an axis or move along a predetermined path. The predetermined path allows the spraying zone to span and successively impregnate a width of the fabric with the treatment chemical fluid. Advantageously, the spraying of chemical fluid allows the treatment of fabric to be better controlled, such that operating parameters (e.g. duration of nozzle opening, volume and/or pressure of fluid, distance to fabric) can be varied.

Preferably, the treatment station is arranged to control a penetration distance of the treatment chemical fluid through the fabric so that the penetration distance can be reproducibly varied as required. The penetration distance is the maximum distance that the treatment chemical passes (i.e. absorbs) into the fabric from the surface of the fabric that is exposed to the spray. At least 10% of the chemical may reach about 90% of this distance. This penetration distance may be controlled by varying the duration, pressure, temperature, viscosity or volume of spray on a fabric, for example. The treatment station improves the repeatability of the treatment process whilst introducing a configurable aspect to the treatment station. The penetration distance may be controlled by spraying the treatment chemical fluid onto one side of the fabric only. Alternatively, the pre-treatment station may include first and second nozzles arranged on opposed sides of the fabric and so as to coat both sides of the fabric. The controlled exposure of the fabric to the treatment chemical improves the repeatability and prevents the fabric from being drenched by treatment chemical. This reduces waste of the treatment chemical fluid, and helps to reduce the required drying times of the treated fabric so that production runs are quicker. Preferably, the penetration distance can be controlled between a depth of around 10% to around 90% of the thickness of the fabric. That is, the maximum extent of the treatment chemical may pass anywhere between 10% and 90% of a fabric's thickness. The penetration distance may be predetermined so that it is repeatable.

Preferably, the treatment station comprises a plurality of nozzles. The plurality of nozzles may operate simultaneously. At least one of the plurality of nozzles may be configured to spray a different treatment chemical fluid from another one of the plurality of nozzles. This allows the concurrent treatment of different chemicals or the successive treatment of the different chemicals. For example, some nozzles may be used for a different production run.

According to an exemplary embodiment, an apparatus for treating fabric is provided. The apparatus includes a treatment station and a drying station as described. The apparatus may be arranged such that a fabric treated with a chemical fluid in the treatment station is then passed on to the drying station such that the treatment and drying mechanisms operate together.

The apparatus may further include a cleaning station configured to remove loose debris from the fabric such as dust or lint caused by manipulation of the fabric. The cleaning station may comprise an adhesive roller to clean the fabric surface by drawing debris from the surface of the fabric.

Preferably, the apparatus further comprises a motion converter, such as a dancing roller, which is a term of art. The motion converter may be arranged between the cleaning station and the treatment station such that the motion converter is configured to receive fabric from the cleaning station and convert the continuous motion of the fabric into intermittent motion. This allows the fabric ahead of the motion converter to be held stationary in cycles. Although it is preferable that the motion converter is disposed between the cleaning station and treatment station, the motion convertor may be disposed between the treatment station and drying station. In the latter instance, the fabric may pass through the cleaning and treatment stations at the same, continuous speed. Furthermore, the motion converter may be position after the drying station. When the motion converter is positioned between the cleaning and treatment stations, the treatment station may be arranged to spray a treatment chemical onto a fabric when the fabric is held stationary in the treatment station. This allows the spraying zone to traverse the fabric such that a width of the fabric is not treated at the same time. This allows width wise portions of fabric to be successively treated.

Preferably, the apparatus comprises a printing station. The printing station may be positioned after the drying station. The printing station may comprise an inkjet printer such that the printing station is an inkjet printing station. The inkjet printing station may be arranged to receive fabric from the drying station and to transfer ink onto the fabric. The transfer of ink may be provided when the fabric is substantially stationary. Therefore, the inkjet printer may traverse the fabric in stages.

Preferably, the stations are provided inline. That is, a station may interact with at least one other station. For example, each station may be arranged to automatically send fabric to an adjacent station and/or may be arranged to automatically receive fabric from an adjacent station without manual intervention.

Preferably, the treatment station and drying station are arranged such that the spraying zone of the treatment station and the drying zone of the drying station are moveable relative with respect to each other. Advantageously, the stations can operate at different rates and are independently configurable. Preferably, the spraying zone and/or drying zone can be moved outside of an area or region defined between the edges of the fabric, i.e. the width wise edges. This allows the spraying zone and/or drying zone to remain switched on while the fabric is moved into the next position. Additionally or alternatively, a plurality of rollers may be arranged to support the fabric outside of the spraying zone such that the fabric is unsupported in the spraying zone. Advantageously, fabric distortion or stretching is prevented because rollers are not present in the spraying zone.

According to an exemplary embodiment, a method for treating fabric is provided. The method includes the steps of transferring a treatment chemical on to a fabric within a spraying zone of a treatment station of the sort as previously described. Once the treatment chemical has been sprayed on the fabric, the method further includes moving the fabric from the treatment station to a drying station of the sort as previously described. The movement may be automatic, i.e. machine activated and controlled. The fabric is then dried in a drying zone of the drying station such that thermal energy causes heating of the fabric and the chemical is absorbed and dried into the fabric. Finally, the fabric is output so that the fabric can be provided in a roll form for storage or transport. Advantageously, the moveable spraying zone and drying zone can work across a width of the fabric whilst the fabric is held stationary.

The method may include preliminary steps, i.e. steps which occur before the treatment zone. These steps may include inputting the fabric into a cleaning station. The fabric may be provided in roll form in the cleaning station. The cleaning station may be provided to remove loose debris from the fabric such as dust or lint accumulated on the fabric. The preliminary steps may further include moving the fabric in a continuous motion through the cleaning station. The fabric may then be passed onto the treatment station. The continuous movement between the cleaning station and the treatment station may be controlled by a motion converter, such as a dancing roller (a term of art). The motion converter may be configured to receive the fabric from the cleaning station and convert the continuous motion of the fabric into intermittent motion, wherein the fabric ahead of the motion converter is held stationary in cycles by movement of the motion converter. In effect, the motion converter provides cyclical movement of the fabric ahead of the motion converter. The motion converter may be provided at any location after the cleaning station but before an inkjet printing station when one is used.

Furthermore, the method may comprise the step of moving the fabric from the drying station to an inkjet printing station, wherein the fabric present within a printing zone of the inkjet printing station receives ink from the inkjet printer. That is, ink is transferred onto the fabric. Once the fabric has been printed on the fabric is output for subsequent processing, storage or transport. When a motion converter is used before the inkjet printing station, the fabric movement can be become intermittent such that the inkjet printer can print onto the fabric in stages. The stop-start nature of the fabric movement is advantageous because the process of working on the fabric is more configurable and repeatable. This provides a user with greater flexibility and control. Finally, the stations of the method may be provided inline, such that each station automatically sends fabric to an adjacent station and/or automatically receives fabric from an adjacent station without manual intervention. The inkjet printing station can therefore be integrated with the cleaning, treatment and/or drying stations so that the fabric is continually worked on. This helps to speed up processing times and reduce downtime. The inline printing of fabric also avoids the risk of damage to the fabric when temporarily stored after being dried.

Advantageously, the treatment and drying stations reduce the fabric's contact with the rollers and other fabric handling systems, which reduces the contamination of the fabric.

BRIEF DESCRIPTION OF DRAWINGS

For a better understanding of the invention, and to show how embodiments of the same may be carried into effect, reference will now be made, by way of example, to the accompanying diagrammatic drawings in which.

DESCRIPTION OF EMBODIMENTS

Figure 1:
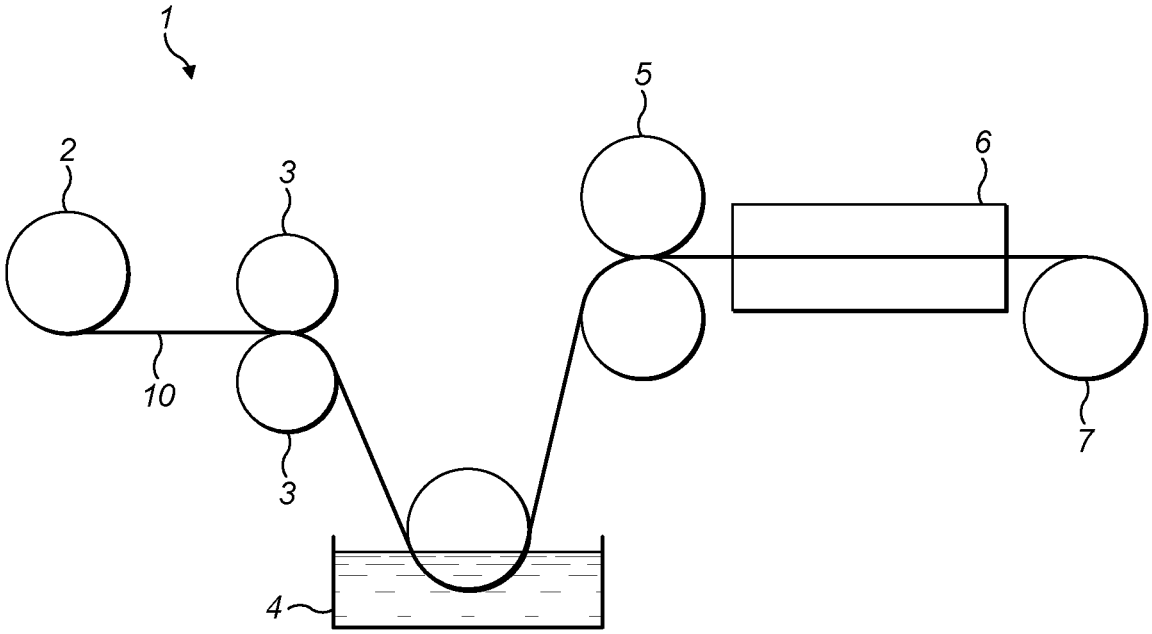
FIG. 1 Prior Art
FIG. 1 shows a known apparatus of pre-treating fabric prior to printing.
Figure 2:
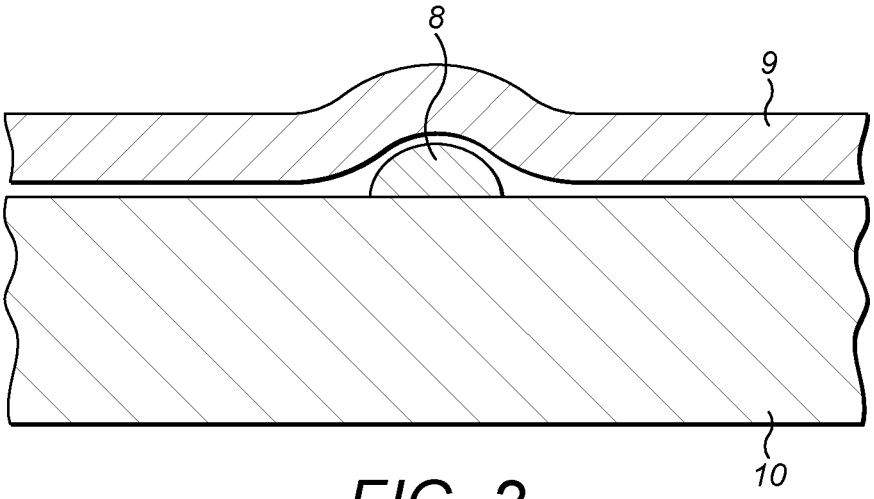
FIG. 2 shows a representation of lint or dust trapped between the ink and fabric layers.
Figure 3:
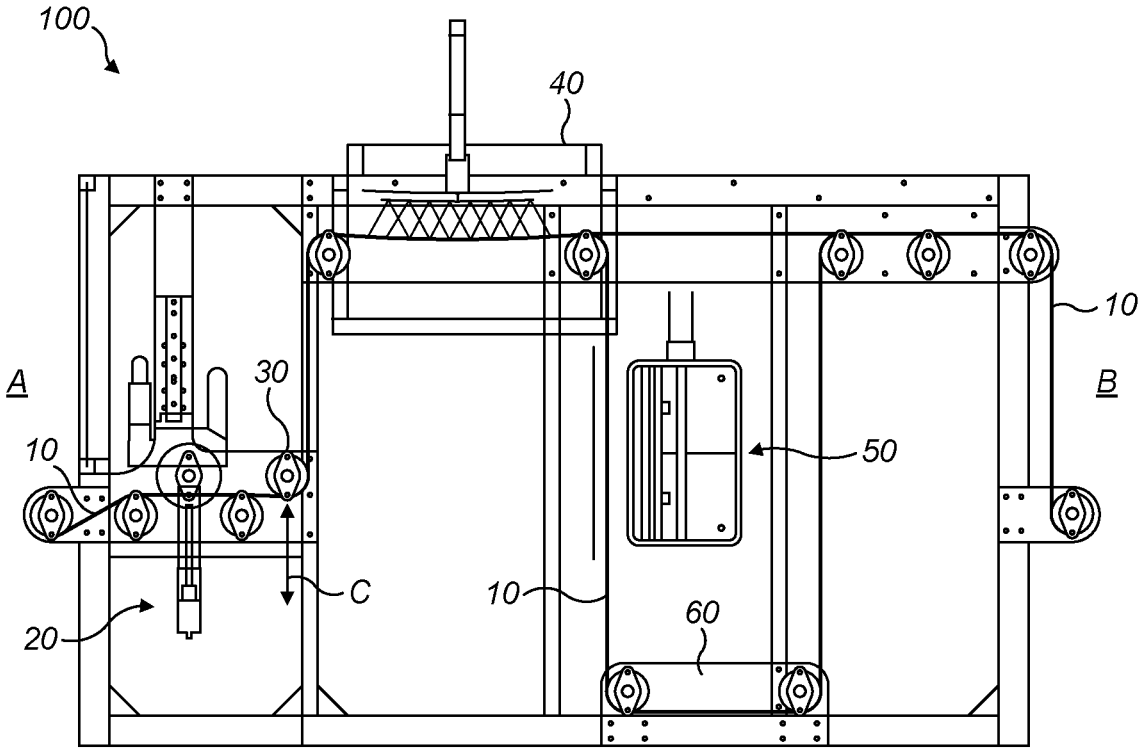
FIG. 3 shows a side view of an apparatus for treating and printing on fabric.
Figure 5:
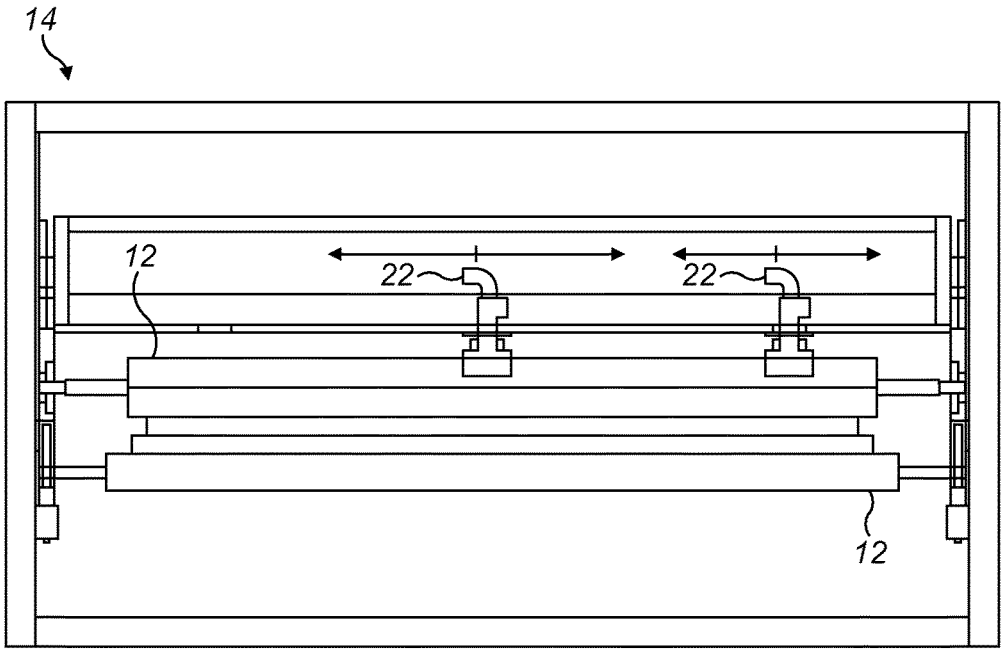
Figure 8:
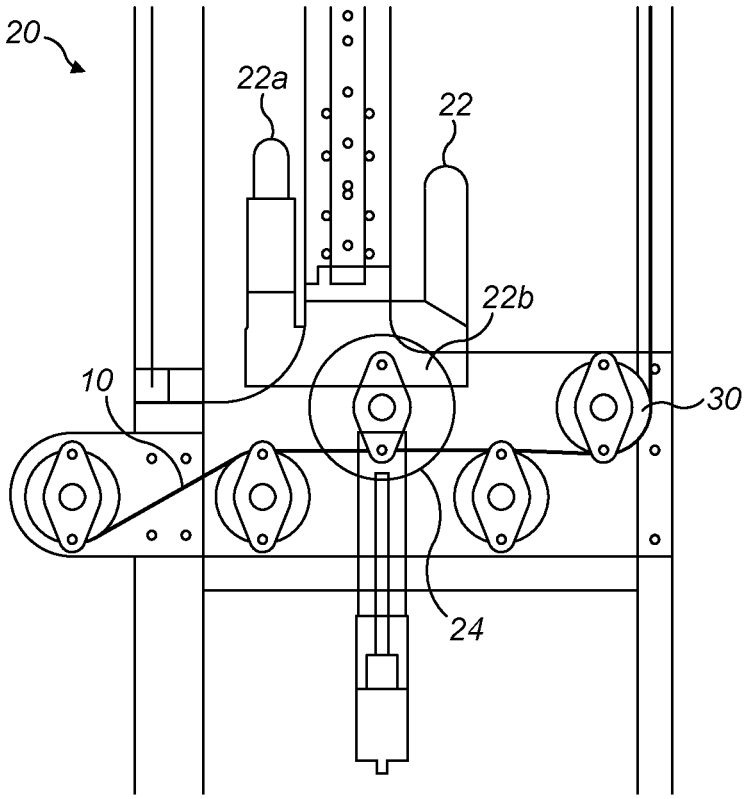
FIG. 8 shows a cleaning station.

FIG. 3 shows a side view of a fabric treatment apparatus (100). Fabric (10) is fed (preferably as a roll) into a cleaning station (20) provided at the input end (A) of the apparatus (100). The cleaning station (20), as shown more clearly in FIG. 8, comprises air suction units incorporating a high pressure water supply and an adhesive coated roller (24) that removes lint or loose debris such as dust from the fabric. Air suction units (22) operate by vacuum effect to clean the adhesive roller and detach the loose material temporarily adhered to the roller (24) as the roller (24) rotatably contacts the fabric (10). The air suction units (22) remove the loose debris from the roller (24) so that the roller (24) can continue to effectively adhere debris from the fabric (10). The suction units (22) move along the roller (24) in a traverse direction to the direction of fabric (10) movement as shown in FIG. 5. The air suction units (22) therefore move in an axial direction parallel to the longitudinal axis of the roller (24) and effectively sweep the rollers (24) as they go. Preferably, the movement of the fabric (10) through the cleaning station (20) is substantially constant or is at least continuous so that no breaks in fabric (10) movement occur. This allows the fabric (10) to be continually fed through the system (100) without interruption. However, in alternative embodiments, the roller is cleaned off-line.

Figure 9A:
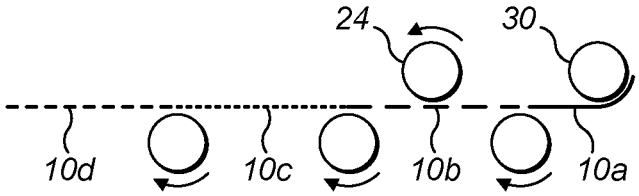
FIGS. 9*a* to 9*c* show the operation of a dancing roller.
Figure 9B:
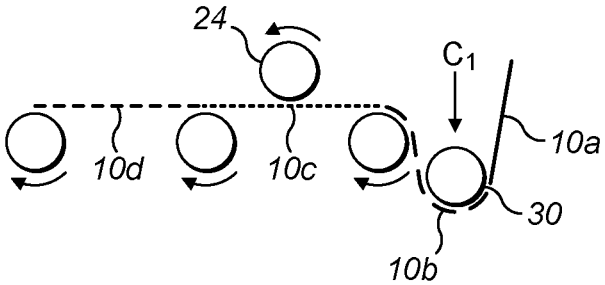
Figure 9C:
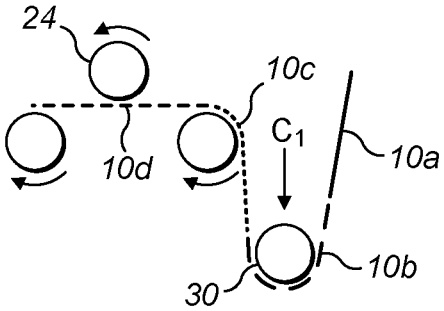

Once the fabric (10) has been cleaned, the fabric (10) is fed towards a dancing roller (30), the function of which is more clearly shown in FIGS. 9*a* to 9*c*. The dancing roller (30) converts the continuous motion of the fabric (10) exiting the cleaning station (20) into intermittent motion for supply to the rest of the apparatus (100). This allows the treatment process to be integrated as one with a printing process comprising an inkjet printer. The dancing roller (also known as an accumulator) is a term of the art and its general operation and effect is known. However, the operation in this current disclosure is briefly described in FIGS. 9*a* to 9*c*.

Figure 9D:
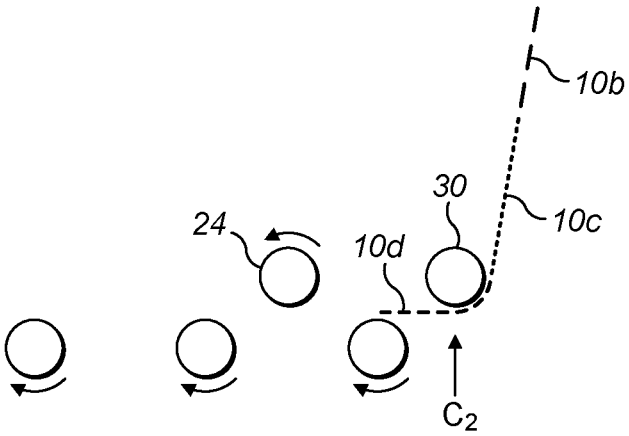

FIGS. 9*a* to 9*c* show the dancing roller (30) in operation. Fabric (10) is divided into four lengths (10*a*,10*b*,10*c*,10*d*). Each length represents a time block of unity and is therefore equal in length when a constant feeding speed is used. The dancing roller (30) has a displaceable axis so that the dancing roller (30) axis moves with respect to the axes of the cleaning rollers. As the fabric (10) is fed towards the dancing roller (30), the dancing roller (30) moves away from adjacent rollers in a downward direction (C1) as shown in FIG. 9*b*. The downward motion is simultaneous with the feeding motion and preferably operates at the same velocity. This allows one end of the first length of fabric (10*a*) to remain effectively stationary. As shown in FIG. 9*c*, the dancing roller (30) continues to move downwards as more fabric (10) is fed from the adjacent roller. This ensures that the fabric (10) does not slacken. Once three time periods have elapsed, the dancing roller (30) returns to the initial position in an upward direction (C2) as shown in FIG. 9*d*. This allows the three lengths of fabric (10*a*,10*b*,10*c*) to be fed towards the next station. Advantageously, the dancing roller (30) converts continuous motion to intermittent motion so that an inkjet printer can be integrated with a pre-treatment station (20).

Figure 4:
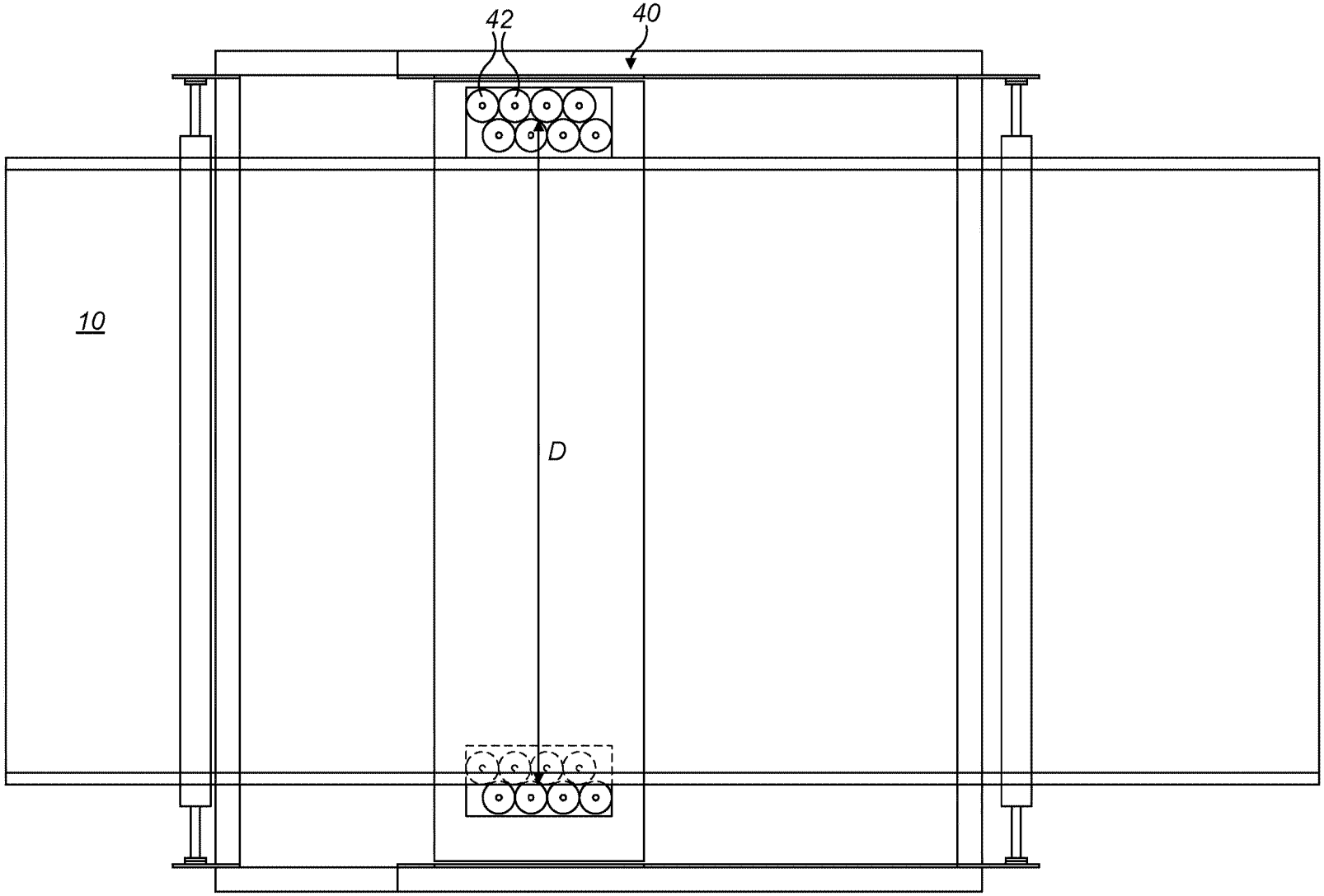
FIGS. 4, 5 and 6 show top, front and back views of the apparatus of FIG. 3, respectively.
Figure 10:
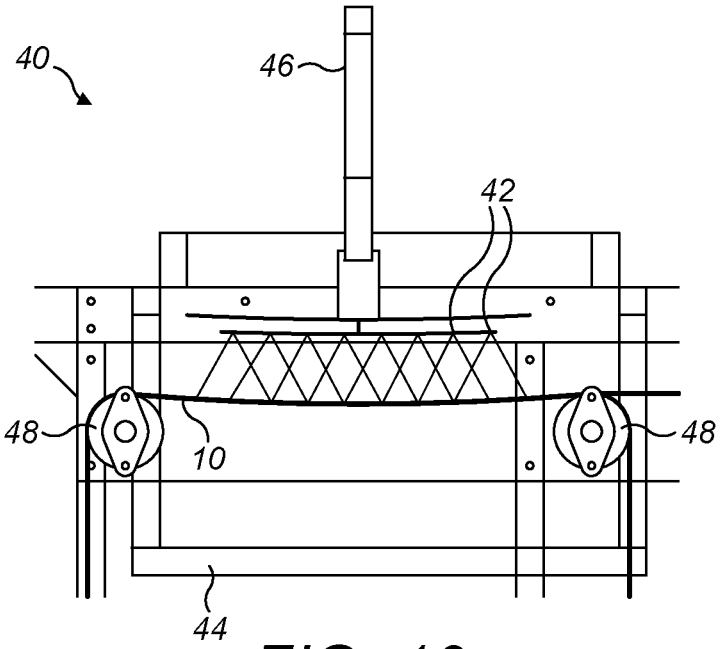
FIG. 10 shows a treatment spraying station.

Referring back to FIG. 3, once the fabric (10) leaves the dancing roller (30) the fabric (10) is sent to the treatment station (40). The treatment station (40), as shown more clearly in FIG. 10, comprises a moveable treatment zone (i.e. a spraying zone) is delineated by the extent of fluid spraying by the nozzles (42) on to the fabric (10). The spraying zone moves by an arm (46) in a transverse direction (D) across the width of the fabric (10), as shown in FIG. 4. Here, the nozzles (42) spray fluid, i.e. pre-treatment chemicals onto one side of the fabric (10) only (i.e. the top side), while moving back and forth in a direction orthogonal to the direction of fabric (10) movement through the apparatus (100). A mechanical atomisation nozzle may be used which avoids the use of air. This allows smaller droplets to be sprayed towards the fabric (10) so that a consistent distribution of treatment fluid is transferred onto the fabric (10). During the fluid spraying stage, the fabric is held substantially constant due to the movement of the dancing roller (30) even though the fabric (10) is continuously fed through the cleaning station (20).

The spraying zone is arranged such that the fabric (10) in contact with rollers (48) is not sprayed onto because contact with the rollers (48) can affect the integrity of the fabric (10) causing localised deformation compared to regions not in contact with the rollers (48). Therefore, only the unsupported fabric (10) is sprayed. That is, the spraying zone is arranged to act on an area between two supporting rollers. The duration, flow rate, pressure, volume, and average droplet size distance of the spray can be controlled in order to intimately affect the transfer or pre-treatment chemical to the fabric (10). For example, a pressure of between 50-100 bar can be used with or without a mechanical atomisation nozzle. A high velocity spray may be used. The spray may be provided as a fine mist of vapour. Therefore, the penetration distance into the fabric (10) from one side of the fabric (10) can be varied. For example, a penetration level between 50-75% can be easily achieved. To prevent the spread of any excess fluid, a barrier (44) is placed below the fabric (10). In addition to the pre-treatment process a post-treatment process may be used. The post-treatment process may transfer chemicals onto the fabric (10) in order to make the fabric (10) water repellent.

Advantageously, the treatment station (40) has the ability to control the penetration level of the treatment fluid by, for example, varying the speed of movement, the pressure, volume, flow rate of fluid ejection and the number of nozzles. This means that there is no need for a mangle to draw excess fluid out of the fabric (10), which helps to make the apparatus (100) more compact and efficient. There is also no need to submerge the fabric (10) in a fluid bath, which improves the quality control of the fluid and avoids the need to store treatment fluid in a reservoir. Furthermore, rollers are not directly exposed to the treatment chemicals during spraying.

Once the fabric (10) has been treated, the fabric (10) is intermittently fed to a drying station (50) as shown in FIG. 3. The drying station includes means for applying heat energy. In some examples, using an emitter supported by a drying support. Suitably, the emitter comprises a heating element. Conveniently, the emitter comprises a reflective backing.

In some examples, the emitter is chosen and tuned to emit radiation of certain range of wavelengths. Conveniently, the range is suitably chosen for the fabric and coating to be dried. In some examples, the emitter is arranged to emit predominantly a narrow range of wavelengths. In one example, the emitter is arranged to emit close to a single wavelength.

For example, for drying fabric, and preferably cotton, a wavelength of more than 1.3 μm (micrometres) is chosen. Preferably, a wavelength of 1.38 μm is selected. Conveniently, for drying cotton a colour temperature in a range of 2000-2200 K (Kelvin) is chosen. In some examples, the colour temperature is 2100 K.

In some examples, the emitter comprises a highly reflective backplate to increase the efficiency of the transfer of energy to the fabric. Additionally or alternatively, a highly reflective plate may be placed opposite to the emitter in a direction of emission such that, in use, fabric is located between the emitter and the highly reflective plate. Conveniently, the highly reflective plate is arranged to reflect emitted energy. Suitably, emitted energy which has passed the fabric may thereby be redirected towards the fabric.

In some examples, the drying station comprises means for transferring mass from the fabric during the drying process. Conveniently, the drying station is configured to remove fluid, preferably moisture, resulting from the drying process.

Conveniently, the amount of heat energy emitted by a drying head of the drying station is chosen for quickly drying the fabric and removing any resulting vapour. In some examples, such may be achieved within a few seconds per square meter and, in one example, one second per square meter.

Figure 11A:
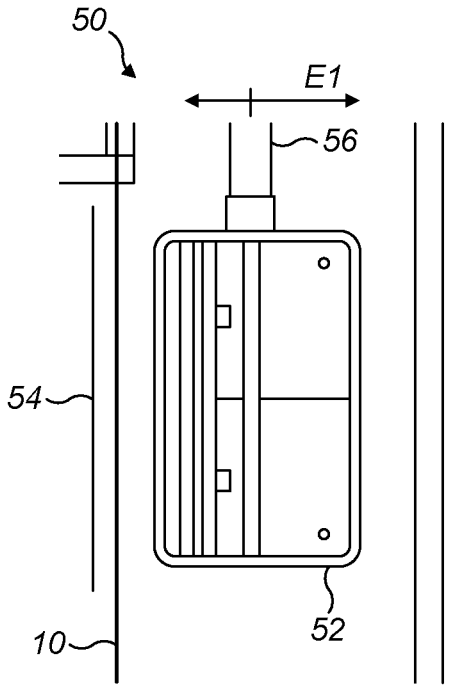
FIGS. 11*a* and 11*b* show a heating station and the movability of the heating unit.
Figure 11B:
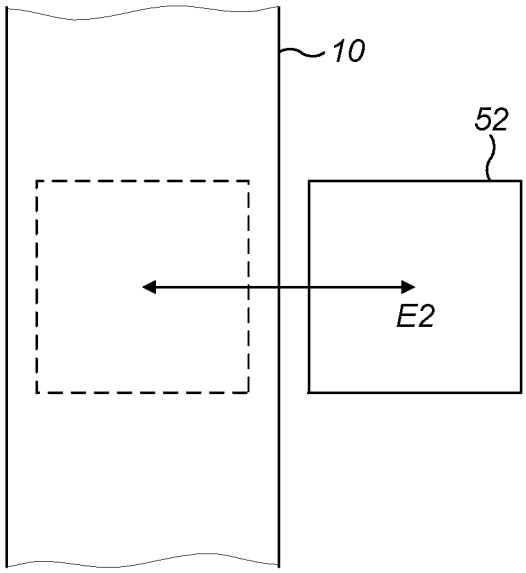

In this example, the drying station, which is more clearly shown in FIGS. 11*a* and 11*b*, comprises a moveable infrared drier (52). When in the drying position, a length of fabric (10) placed between the infrared drier (52) and a heat shield (54), such as a reflector, is heated by the thermal energy transferred by the infrared radiation. The region of thermal energy emitted from the infrared drier (52) is the drying zone. The proximity of the infrared drier (52) to the fabric can be varied in order to affect the speed of drying and/or heating. For example, a distance of between 100-200 mm can be used when the infrared drier (52) is static or a closer distance of between 25-100 mm, or preferably 10-50 mm, can be used when there is relative movement between the infrared drier (52) are the fabric (i.e. the infrared driver (52) is continuously moving). This allows the infrared drier to be close to the surface of the fabric (10) to be dried and/or heated. Advantageously, the use of an infrared drier (52) allows the drying means to be turned on and off as required because the infrared drier (52) can warm up quickly without detrimental performance effects. Furthermore, the drying zone can be well controlled. For example, the speed of the drier (52) relative to the fabric (10) can be varied as well as the distance between the drier (52) and the fabric (10).

A moveable arm (56) connected to the infrared drier (52) is configured to move relative to the fabric (10) when the fabric (10) is held in position. For example, the infrared drier (52) may move towards or away from the fabric (10) in a first direction (E1) and side-to-side in a second direction (E2), substantially orthogonal to the first direction (E1). The infrared drier (52) may move beyond the edges of the fabric (10). This helps to evenly spread the distribution of heat and avoid scorching of the fabric (10). The sideways movement of the infrared heater (52), i.e. in the second direction, is preferably timed according to the movement of the dancing roller (30) and the spraying of the fabric (10). Therefore the fabric can be held in position in a stop-start nature to allow sections of the fabric (10) to be acted on at once. Alternatively, or additionally, the drier (52) may rotate away from the fabric (10) such that the drying rate of the fabric (10) is reduced even if the drier (52) remains on. Additionally, air movement over the fabric (10) may be used by blowing or suction force in order to encourage the removal of fluid particles from the fabric (10). Additionally, or alternatively, the infrared drier (52) may move in an up and down direction, i.e. a third direction, which is substantially orthogonal to the first and second directions. This adds further configurability depending on the type of drying required.

After the drying station (50), the fabric is sent through a printing station, which may be a separate station. When an inkjet printer is used (not shown), the printing nozzles acting on the fabric (10) move across the fabric (10) in a side-to-side motion. During the sideways movement of the nozzles, the fabric (10) is held substantially stationary in order to allow the ink to be passed onto the fabric (10) in a linear fashion. An array of nozzles arranged in a column (i.e. along the fabric (10)) may be used in order to concurrently move across the fabric (10) and act on a larger surface area. This allows a row of the fabric (10) to be printed on at once (as determined by the dancing roller (30)) before being moved out of the way by the next row of unprinted fabric (10). Advantageously, the continuous motion of the cleaning station (20) does not disrupt the stop-start motion required by the printing station (60).

Figure 6:
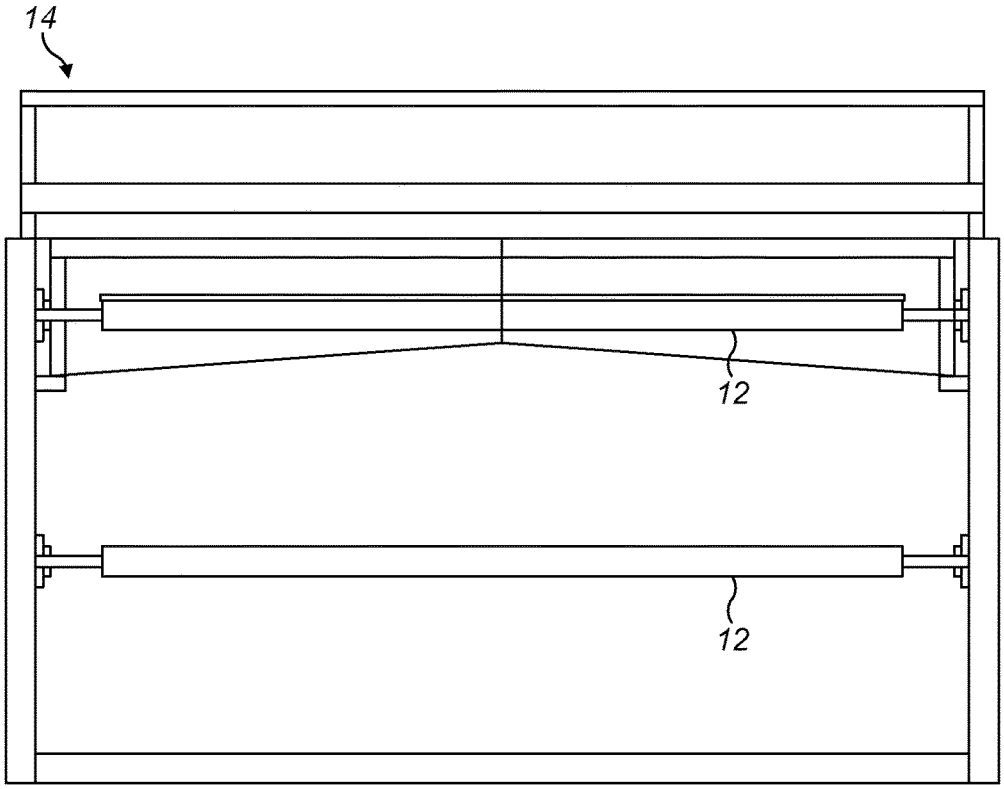

FIGS. 5 and 6 show the front and back views of the apparatus, respectively. Typically, the rollers (12) are elongate to reduce inertial load and accommodate fabric (10) that may be at least 3 m in width. The rollers (12) each has a rotation axis which may be powered or unpowered. Therefore, some rollers (12) may be used to drive the fabric (10) forward or may freewheel such that they spin freely. The axes of the rollers (12) are shown attached to framework (14) that provides the structure of the apparatus (100).

Figure 7:
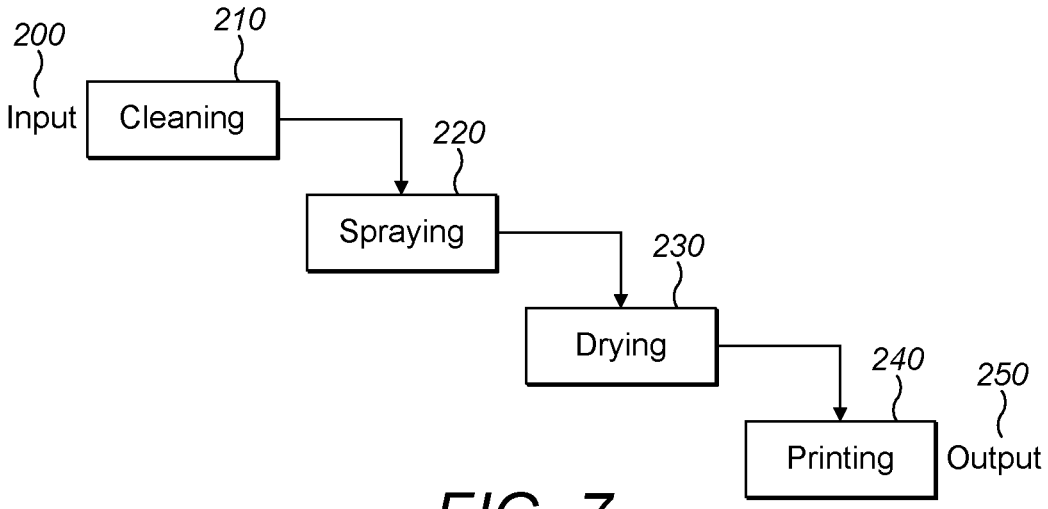
FIG. 7 shows a flow diagram of the treatment and printing processes.

FIG. 7 show a flow diagram of the apparatus (100) as a whole. The apparatus (100) is configured to receive a roll of fabric (10) and input the fabric (10) as a continuous length. After the input stage (200), the fabric is continuously fed to a cleaning stage (210), where debris is removed from the fabric (10) from at least one side of the fabric (10). The continuous motion of the fabric (10) movement is then changed into intermittent motion. Therefore sections of the fabric (10) are then fed to a spraying stage (220), whereby the fabric (10) is coated from at least one side with a pre-treatment fluid. The amount of penetration is controlled in order to embed the fabric (10) accordingly. After the spraying stage (220), sections of the fabric (10) are intermittently fed to a drying station (230), where the fabric (10) is dried in and the pre-treatment fluid is retained by the fabric (10). This drying action may extend to a heating action in order to prepare the fabric (10) for printing by inkjet. Once exposed to a drier in the drying stage (230), the fabric (10) is fed to a printing stage (240), whereby the fabric (10) is printed on by ink. This allows graphics to be applied to the pre-treated and dried fabric (10) before being outputted (250) for delivery or storage.

Advantageously, the apparatus minimises changeover disruption so that a different pre-treatment chemical can be quickly and more conveniently changed. The extent of chemical penetration into the fabric can be controlled by the use of nozzles. The to provide a more flexible method of embedding the fabric. The moveable drier and/or improved transient nature of the drier prevents the fabric being scorched and allows the drying process to be unaffected when stationary. The moveable drying and/or spraying zone allows the fabric to be held in position. In summary, the apparatus provides greater customisation and flexibility for improved efficiency and reduced downtime.

Although preferred embodiment(s) of the present invention have been shown and described, it will be appreciated by those skilled in the art that changes may be made without departing from the scope of the invention as defined in the claims.

The invention claimed is:

1. An apparatus for drying fabric, comprising a drying station comprising an emitter supported by a moveable arm, the emitter arranged to emit infrared radiation toward the fabric, the extent of which defining a drying zone, wherein the emitter is moveable in a predetermined way such that the drying zone is configured to span a width of fabric and successively dry the width of fabric;

the apparatus further comprising a plurality of rollers for handling the fabric including at least one dancing roller configured to move relative to at least one other roller of the plurality of rollers; wherein the moveable arm is configured to move the emitter relative to the fabric when the fabric is held in position.

2. The apparatus according to claim 1, wherein the emitter is moveable along a predetermined path.

3. The apparatus according to claim 2, wherein the moveable arm is configured to move the emitter beyond the edges of the fabric.

4. The apparatus according to claim 3, wherein the drying station includes an extension along which the emitter is is adapted to move, and further wherein the extension and the predetermined path are collinear.

* * * * *